US011654698B2

(12) United States Patent
Sayama et al.

(10) Patent No.: US 11,654,698 B2
(45) Date of Patent: May 23, 2023

(54) DRYING APPARATUS AND IMAGE FORMING SYSTEM

(71) Applicant: KYOCERA Document Solutions Inc., Osaka (JP)

(72) Inventors: Haruki Sayama, Osaka (JP); Masaki Murashima, Saka (JP); Shota Nakayama, Osaka (JP); Hitoshi Hayamizu, Osaka (JP); Keisuke Yamashita, Osaka (JP); Tomoya Hotani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/679,526

(22) Filed: Feb. 24, 2022

(65) Prior Publication Data

US 2022/0281240 A1 Sep. 8, 2022

(30) Foreign Application Priority Data

Mar. 2, 2021 (JP) ..... JP2021-032628

(51) Int. Cl.
*B41J 11/00* (2006.01)

(52) U.S. Cl.
CPC ..... *B41J 11/00212* (2021.01)

(58) Field of Classification Search
CPC ..... B41J 11/00212; B41J 11/00216; B41J 11/0022
See application file for complete search history.

(56) References Cited

U.S. PATENT DOCUMENTS

2019/0263144 A1* 8/2019 Nishiura ..... B41M 7/0081

FOREIGN PATENT DOCUMENTS

JP H08-142319 A 6/1996
JP H09-314818 A 12/1997

* cited by examiner

*Primary Examiner* — Bradley W Thies
(74) *Attorney, Agent, or Firm* — Studebaker & Brackett PC

(57) ABSTRACT

A drying apparatus which dries a medium on which an image is formed with ink while conveying the medium includes a conveyance part, a heating part, a measurement part and a controller. The conveyance part conveys the medium in a predetermined conveyance direction. The heating part supplies energy to the image on the sheet conveyed in the conveyance part and dries the image. The measurement part measures a value accompanied with moisture contained in the medium. The controller estimates an amount of moisture contained in the medium based on the value measured by the measurement part, and controls at least one of the conveyance part and the heating part so as to change an amount of the energy supplied to the image based on the estimated amount of moisture.

13 Claims, 4 Drawing Sheets

DRYING APPARATUS AND IMAGE FORMING SYSTEM

INCORPORATION BY REFERENCE

This application is based on and claims the benefit of priority from Japanese patent application No. 2021-032628 filed on Mar. 2, 2021, which is incorporated by reference in its entirety.

BACKGROUND

The present disclosure relates to a drying apparatus which dries a recording medium on which an image is formed with an ink while conveying the recording medium and an image forming system including the drying apparatus.

The image forming system including an inkjet type image forming apparatus includes a drying apparatus which dries an image formed on a recording medium, such as a paper sheet.

The drying apparatus irradiates the image (the ink) on the recording medium with light, evaporates moisture contained in the ink using energy generated when the ink absorbs the light, and then dries the image. In order to satisfy the conveyance performance of the recording medium and the quality of the image, it is necessary to keep the drying degree at a predetermined level to prevent an insufficient drying and an excessive drying. For example, the insufficient drying causes offset in which the ink is transferred to members in contact with the printed surface of the recording medium and then the transferred ink is further transferred to the recording medium, or image blur. Further, the excessive drying causes yellowing or curling of the recording medium, and the recording medium may be jammed or unnecessary electric power may be consumed.

To solve such a problem, it is necessary for a user to adjust the drying apparatus while performing test printing so as to achieve a drying degree of the recording medium corresponding to a printing purpose, and it is troublesome to adjust the drying apparatus.

On the other hand, there is a recording apparatus which controls a heat quantity of a heat source depending on to an amount of a black colored area of a recording data. Further, there is an inkjet recording apparatus which heats an ink supplied area depending on a size of a sheet.

However, the above recording apparatus and the inkjet recording apparatus do not consider the adjustment of drying degree, and it is difficult to eliminate the problems such as the offset and the curling described above.

SUMMARY

In accordance with an aspect of the present disclosure, a drying apparatus which dries a medium on which an image is formed with ink while conveying the medium includes a conveyance part, a heating part, a measurement part and a controller. The conveyance part conveys the medium in a predetermined conveyance direction. The heating part supplies energy to the image on the sheet conveyed in the conveyance part and dries the image. The measurement part measures a value accompanied with moisture contained in the medium. The controller estimates an amount of moisture contained in the medium based on the value measured by the measurement part, and controls at least one of the conveyance part and the heating part so as to change an amount of the energy supplied to the image based on the estimated amount of moisture.

In accordance with an aspect of the present disclosure, an image forming system included an image forming apparatus which forms an image on a sheet; and the drying apparatus drying the medium on which the image is formed by the image forming apparatus, while conveying the medium.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the attached drawings, an image forming system and a drying apparatus according to one embodiment in the present disclosure will be described.

Figure 1:
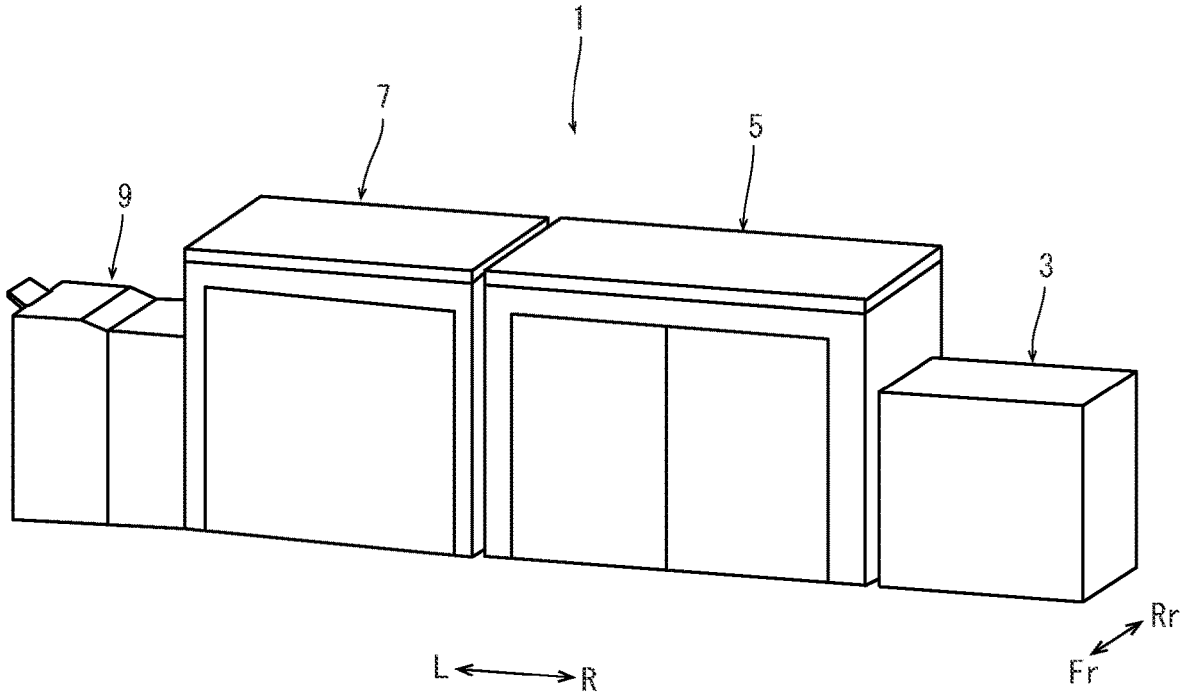
FIG. 1 is a perspective view schematically showing an image forming system according to one embodiment of the present disclosure.

First, with reference to FIG. 1, the image forming system 1 including the drying apparatus 7 will be described. FIG. 1 is a perspective view showing the image forming system 1. L, R, Fr and Rr marked in each drawing indicate the left side, the right side, and the front side and the rear side of the image forming system 1.

The image forming system 1 includes a sheet feeding apparatus 3, an image forming apparatus 5, the drying apparatus 7 and a post-processing apparatus 9. The sheet feeding apparatus 3 stores a sheet and feeds the sheet to the image forming apparatus 5. The image forming apparatus 5 is disposed on the left side of the sheet feeding apparatus 3, and forms an image on the sheet fed from the sheet feeding apparatus 3 in the inkjet image forming manner based on image data, for example, transmitted from an external computer. The drying apparatus 7 is disposed on the left side of the image forming apparatus 5, and dries the sheet on which the image is formed while conveying the sheet. The post-processing apparatus 9 is disposed on the left side of the drying apparatus 7, and performs a post-processing on the sheet dried by the drying apparatus 7. The sheet is an example of a medium in the present disclosure.

The image forming system 1 is further provided with an ultrasonic sensor 11 (see FIG. 4) which detects a thickness of the sheet on which the image is to be formed. The ultrasonic sensor 11 is a transmission type sensor including a transmission part and a reception part which are disposed on both sides of an object to be detected (the sheet in the present embodiment), for example. The ultrasonic wave transmitted from the transmission part is received by the reception part, and the thickness of the sheet is detected based on a transmission amount of the ultrasonic wave. The ultrasonic sensor 11 is provided in the sheet feeding apparatus 3 or the image forming apparatus 5, for example.

Figure 2:
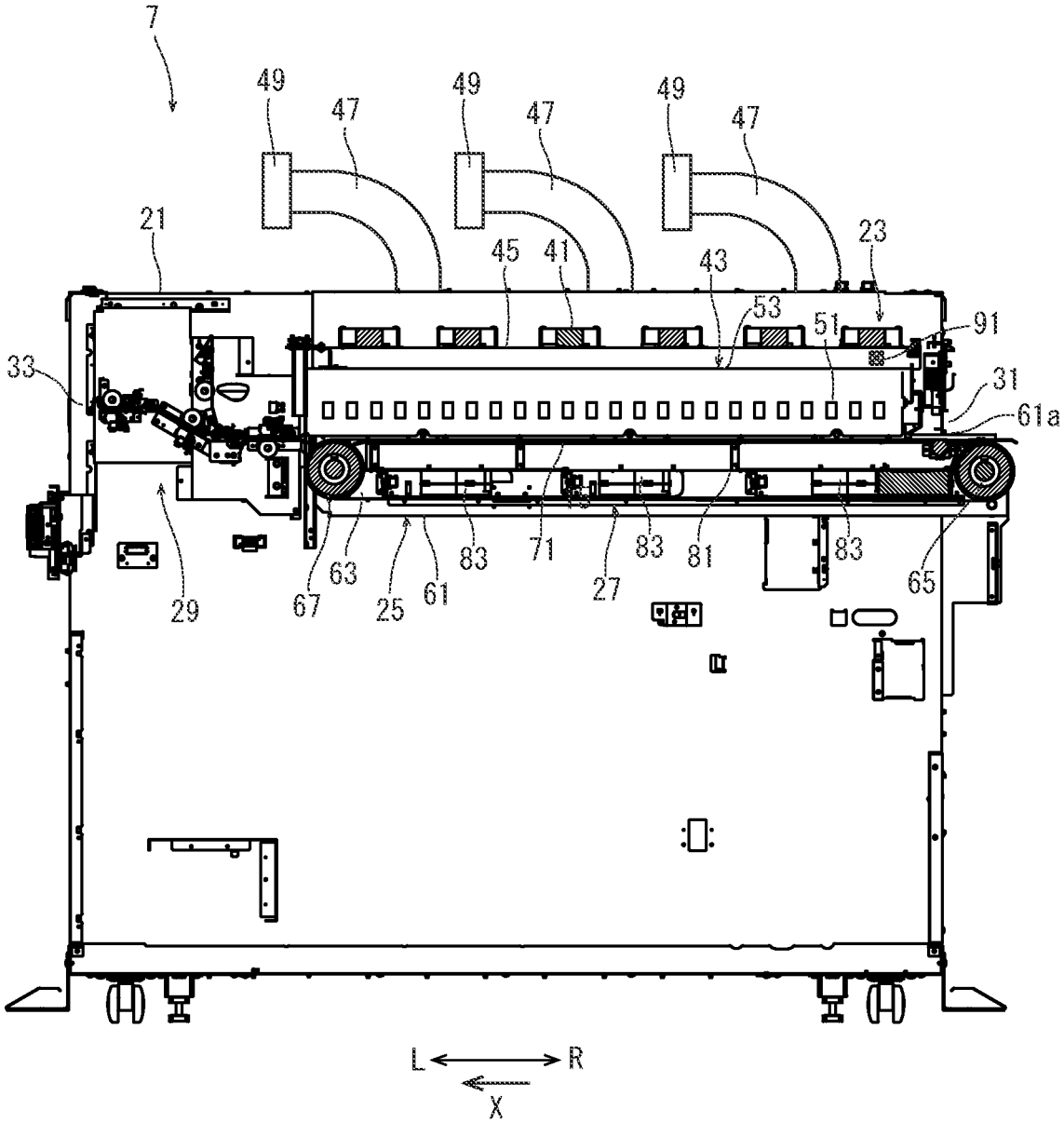
FIG. 2 is a front view showing an inside of a drying apparatus according to the embodiment of the present disclosure.
Figure 3A:
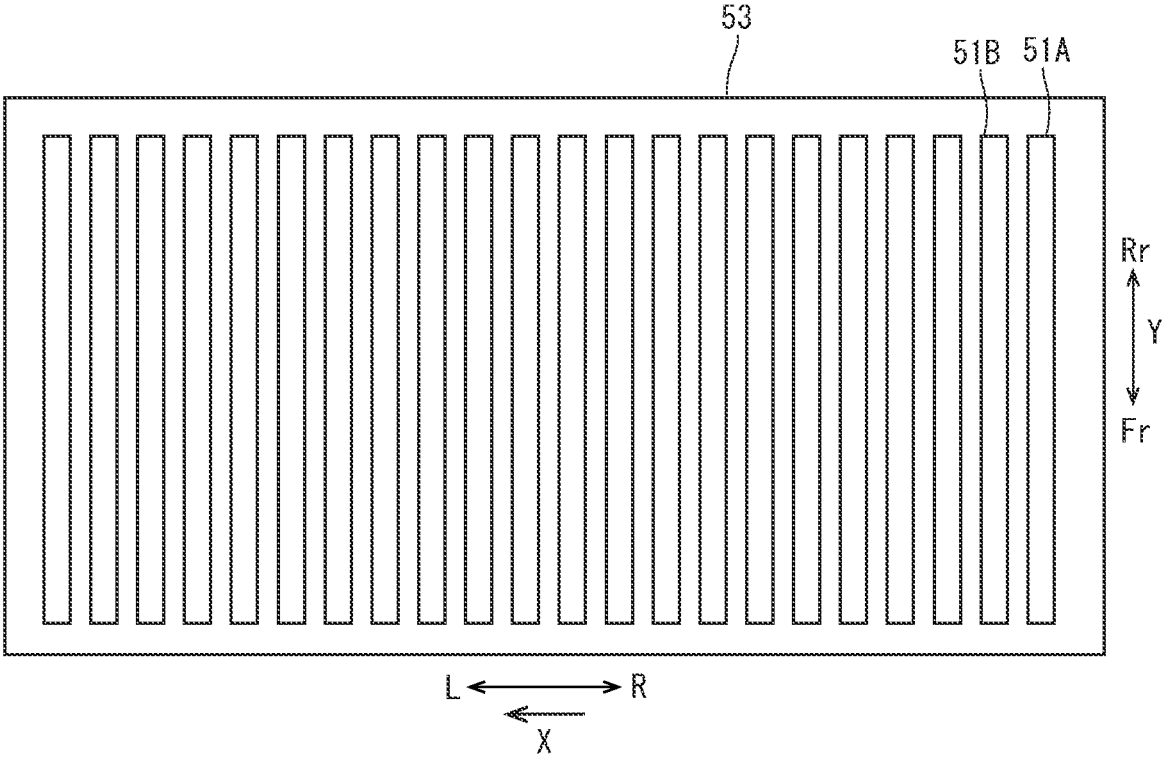
FIG. 3A is a plan view showing a heater of a heating part in the drying apparatus according to the embodiment of the present disclosure.
Figure 3B:
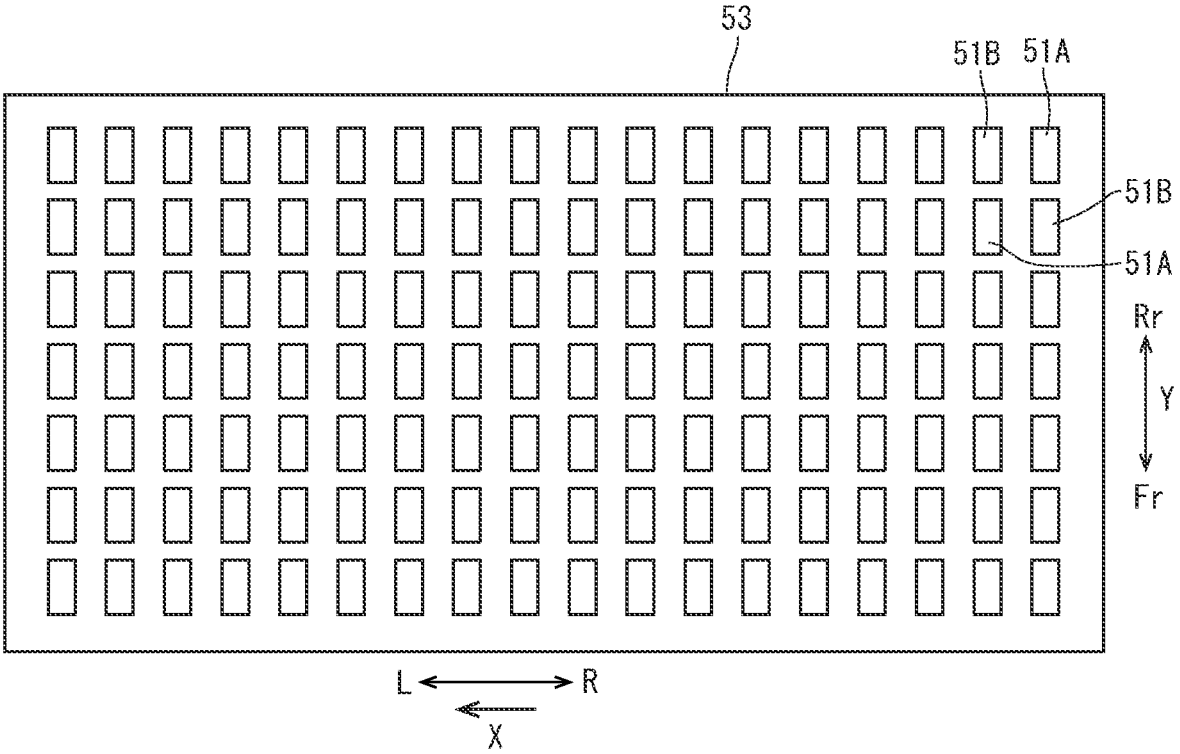
FIG. 3B is a plan view showing the heater of the heating part in the drying apparatus according to the embodiment of the present disclosure.
Figure 4:
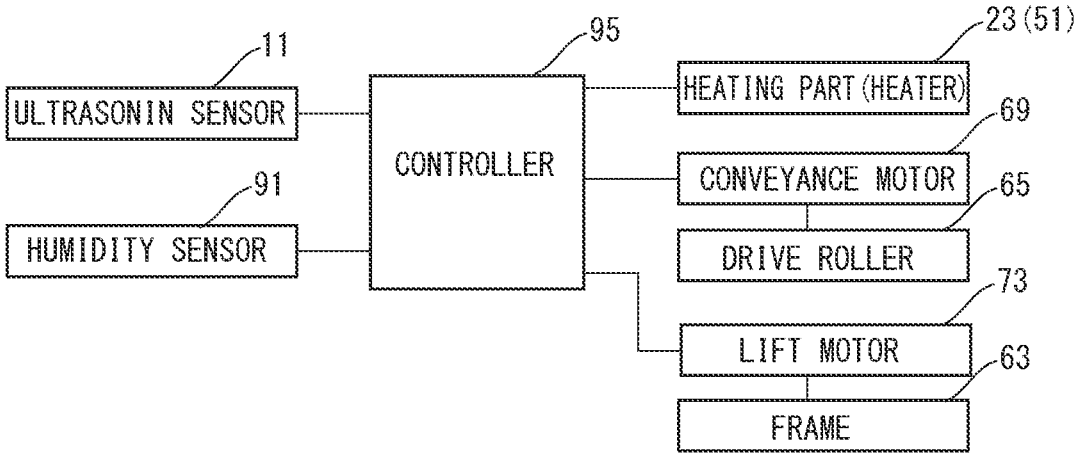
FIG. 4 is a block diagram showing a controller in the drying apparatus according to the embodiment of the present disclosure.

Next, the drying apparatus 7 will be described with reference to FIG. 2, FIG. 3A, FIG. 3B and FIG. 4. FIG. 2 is a front view showing the inside of the drying apparatus 7. FIG. 3A and FIG. 3B are plan views showing a heater 51 of a heating part 23. FIG. 4 is a block diagram showing a controller 95 of the drying apparatus 7.

The drying apparatus 7 includes a box-shaped housing 21. The housing 21 has a parallelepiped inner space surrounded by a top plate, a bottom plate, a front side plate, a rear side plate, a left side plate and a right side plate. In the inner space, the heating part 23, a conveyance part 25 and a suction part 27 are housed on the side of the image forming apparatus 5 (the right side). In the upper portion of the inner space, a cooling part 29 is housed on the side of the post-processing apparatus 9 (the left side).

In the upper portion of the right side plate of the housing 21 (the side plate on the side of the image forming apparatus 5), a reception port 31 through which the sheet (the medium) is received from the image forming apparatus 5 is formed. In the upper portion of the left side plate of the housing 21 (the side plate on the side of the post-processing apparatus 9), a discharge port 33 through which the sheet is transferred to the post-processing apparatus 9 is formed. Along a conveyance direction X from the reception port 31 to the discharge port 33, the sheet is conveyed by the conveyance part 25 and the cooling part 29. In the following description, the upstream side and the downstream side indicate the upstream side and the downstream side in the conveyance direction X. A direction perpendicular to the conveyance direction X is referred to as a width direction Y.

Next, the heating part 23 will be described. The heating part 23 includes a plurality of air blow fans 41, a heater unit 43, and a case 45 by which the air blow fans 41 are supported and in which the heater unit 43 is housed.

The case 45 is formed in a box-like shape whose lower surface is opened, and has an inner space long in the conveyance direction X surrounded by a top plate, a front side plate, a rear side plate, a left side plate and a right side plate. The top plate has a plurality of exhaust openings (not shown). To each exhaust opening, an exhaust fan 49 is connected through a duct 47. By driving each exhaust fan 49, the air in the case 45 is exhausted to circulate the air inside the case 45.

The air blow fans 41 are supported by the top plate of the case 45. The air blow fans 41 take the outside air in, and send it to the inner space of the case 45.

The heater unit 43 includes a plurality of infrared heaters 51, and a housing 53 in which the infrared heaters 51 are housed.

The housing 53 is formed in a box-like shape whose lower surface is opened, and has an inner space long in the conveyance direction X surrounded by a top plate, a front side plate, a rear side plate, a left side plate and a right side plate. A large number of through holes is formed over the top plate.

Each heater 51 has a thin plate-shaped carbon filament and a glass tube in which the filament is housed, for example. The filament irradiates light (infrared light) in all radial directions (360 degrees). As shown in FIG. 3A, the heaters 51 are disposed at equal intervals along the conveyance direction X in a posture along the width direction Y. The heaters 51 can be turned on and off individually.

Next, the conveyance part 25 will be described. The conveyance part 25 includes a conveyance belt 61 and a frame 63 which supports the conveyance belt 61. The frame 63 has front and rear side plates which are long in the conveyance direction X and disposed at a predetermined interval in the front-and-rear direction. A drive roller 65 is rotatably supported between the upstream end portions of the front and rear side plates, and a driven roller 67 is rotatably supported between the downstream end portions of the front and rear side plates.

The conveyance belt 61 is an endless belt, and a large number of through-holes (not shown) are formed over the entire surface. The conveyance belt 61 is stretched around the drive roller 65 and the driven roller 67. The drive roller 65 is connected to a conveyance motor 69 (see FIG. 4). When the drive roller 65 is driven by the conveyance motor 69 to be rotated, the conveyance belt 61 travels in the counterclockwise direction in FIG. 2 at the preset reference speed. The outer surface of the conveyance belt 61 along the upper track (along the direction from the upstream side to the downstream side) serves as a conveyance surface 61*a* on which the sheet is conveyed. A distance between the conveyance surface 61*a* and the heating part 23 is preset to a reference distance. The conveyance belt 61 traveling on the upper track is supported by a conveyance plate 71 supported by the front and rear side plates. A large number of through-holes is formed over the entire surface of the conveyance plate 71. When the conveyance belt 61 travels, the rear surface (the surface opposite to the conveyance surface 61*a*) of the conveyance belt 61 traveling on the upper track slides along the conveyance plate 71.

The conveyance part 25 is formed longer than the heating part 23 on the upstream side in the conveyance direction X. Specifically, the upstream end portion of the conveyance surface 61*a* of the conveyance belt 61 extends upstream of the upstream end portion of the heating part 23 and upstream of the reception port 31. The downstream end portion of the conveyance surface 61*a* is positioned at substantially the same position as the downstream end portion of the heating part 23, and is communicated with the cooling part 29.

The frame 63 is supported by the housing 21 in a liftable and lowerable manner. To the frame 63, a lift motor 73 (see FIG. 4) is connected via a winding roller and a pulley (not shown), for example. When the lift motor 73 is driven, the conveyance part 25 is lowered from a conveyance position where the conveyance surface 61*a* faces the heating part 23 at the reference distance to a retract position where the conveyance surface 61*a* is lowered from the heating part 23 by a distance larger than the reference distance. When the conveyance part 25 is lowered to the retreat position, it becomes possible to treat the sheet jamming occurred on the conveyance surface 61*a*. The description of the lifting and lowering mechanism for the conveyance part 25 is omitted.

Next, the suction part 27 will be described. The suction part 27 is provided in the inner space of the conveyance belt 61. The suction part 27 includes a partition plate 81 and a plurality of (in the example, three) suction fans 83 which are supported by the partition plate 81. The partition plate 81 has a bottom plate and partition walls, and divides the inner space into a plurality of (in this example, three) sections along the conveyance direction X. The upper surface of each section is opened and faces the conveyance plate 71.

The suction fan 83 is attached to the bottom plate of the separation plate 81 so as to correspond to each section. The suction fans 83 have the same flow amount. When the suction fans 83 are driven, the air in the space above the conveyance belt 61 (the conveyance surface 61*a*) traveling along the upper track is taken in each section through the through-holes of the conveyance belt 61 and the through-holes of the conveyance plate 71.

Further, a humidity sensor 91 is provided in the inside of the housing 21 of the drying apparatus 7. In the embodiment, the humidity sensor 91 is provided in the case 45 of the heating part 23.

Next, with reference to FIG. 4, a controller 95 of the image forming system 1 will be described. The controller 95 is electrically connected to the ultrasonic sensor 11 and the humidity sensor 91. The detection results of the ultrasonic sensor 11 and the humidity sensor 91 are transmitted to the controller 95. The controller 95 is further provided with a count unit which counts an accumulated value of dots constituting the image data of the image formed in the image forming apparatus 5. The ultrasonic senor 11, the humidity sensor 91, and the count unit (the controller 95) are examples of a measurement part which measures a value associating with an amount of moisture contained in the sheet.

Further, the controller 95 is electrically connected to the heating part 23, and turns on and off each heater 51 individually. The controller 95 allows to change a turn-on period and a turn-off period of each heater 51.

Further, the controller 95 is electrically connected to the conveyance motor 69 of the conveyance part 25, and controls the rotational speed of the drive roller 65 to travel the conveyance belt 61 at the predetermined conveyance speed or a conveyance speed slower than the predetermined conveyance speed.

Further, the controller 95 is electrically connected to the lift motor 73 of the conveyance part 25, and controls the rotational direction and the rotational period of the lift motor 73 to lift and lower the conveyance part 25 (the frame 63) between the conveyance position and the retreat position. The controller 95 can also drive the lift motor 73 to lower the conveyance part 25 to the predetermined position between the conveyance position and the retreat position, or to lift the conveyance part 25 to a position closer to the heating part 23 than the conveyance position. The position closer to the heating part 23 than the conveyance position is set such that the sheet is not excessively heated.

An example of the drying operation of the drying apparatus 7 having the above configuration will be described with reference to FIG. 2 to FIG. 4 mainly. The sheet on which an image is formed by the image forming apparatus 5 (see FIG. 1) is received in the conveyance part 25 through the reception port 31 of the drying apparatus 7. As described above, since the upstream end portion of the conveyance surface 61*a* of the conveyance belt 61 extends upstream of the reception port 31, the sheet discharged from the image forming apparatus 5 is placed on the conveyance surface 61*a* of the conveyance belt 61.

The controller 95 drives the conveyance motor 69 at the predetermined reference rotational speed and rotates the drive roller 65 to travel the conveyance belt 61. As a result, the sheet placed on the conveyance surface 61*a* is conveyed into the housing 21 through the reception port 31.

Further, the air blow fans 41 of the heating part 23 are driven. The air taken in the inner space of the case 45 by the air blow fans 41 is sent downward and enters the inside of the housing 53 of the heater unit 43.

Further, the suction fans 83 of the suction part 27 are driven. As a result, as described above, the air in the space above the conveyance belt 61 traveling along the upper track is taken in each section through the through-holes of the conveyance belt 61 and the through-holes of the conveyance plate 71, and the pressure of the space above the conveyance surface 61*a* becomes negative. Then, the sheet conveyed on the conveyance surface 61*a* of the conveyance belt 61 is attracted to the conveyance surface 61*a*.

The controller 95 estimates an amount of moisture contained in the sheet from the detection results of the ultrasonic sensor 11 and the humidity sensor 91 and the amount of the ink calculated in the count unit. Specifically, the controller 95 compares the intensity of the ultrasonic wave detected by the ultrasonic sensor 11 with the intensity of the reference ultrasonic wave in the case of the sheet having the predetermined thickness, and when the detected intensity is smaller than the intensity of the reference wavelength, it is estimated that the amount of moisture contained in the sheet is larger than the predetermined amount of moisture. The intensity of the reference ultrasonic wave is the intensity when one sheet set in the image forming system 1 is detected by the ultrasonic sensor 11, for example. The predetermined amount of moisture is the amount of moisture when the sheet can be dried without causing the offset or the curling, for example. This method is referred to as a first estimation method.

Further, the controller 95 compares the ambient humidity detected by the humidity sensor 91 with the preset reference humidity, and when the detected ambient humidity is higher than the reference humidity, it is estimated that the amount of moisture contained in the sheet is larger than the predetermined amount of moisture. The reference humidity is the average humidity in the operating environment of the image forming system 1, for example. This method is referred to as a second estimation method.

Further, the controller 95 compares the amount of ink calculated by the count unit with the preset reference amount of ink, and when the calculated amount of ink is larger than the reference amount of ink, it is estimated that the amount of moisture contained in the sheet is larger than the predetermined amount of moisture. The reference amount is the average value of the amount of ink amount used for forming the image on one sheet in the image forming system 1, for example. This method is referred to as a third estimation method.

When it is estimated that the amount of moisture contained in the sheet is larger than the predetermined amount of moisture in any one of the first to the third estimation methods, the controller 95 turns on and off the adjacent heaters 51A and 51B alternately as shown in FIG. 3A. At this time, the controller 95 sets the turn-on period longer than the reference turn-on period.

On the other hand, when it is estimated that the amount of moisture contained in the sheet is not larger than the predetermined amount of moisture in any one of the first to the third estimation methods, the controller 95 turns on and off the heaters 51 for a fixed period.

By turning on and off the heater 1 as described above, the air entered in the housing 53 is heated by the infrared irradiated from the heater 51. The heated air is blown to the sheet conveyed on the conveyance surface 61*a* of the conveyance belt 61 to dry the ink.

The sheet is conveyed on the conveyance surface 61*a* from the upstream side to the downstream side, and the ink is dried by the heating part 23.

While the sheet is conveyed on the conveyance surface 61*a*, the insides of the case 45 of the heating part 23 and the housing 53 of the heater unit 43 are under a high-humidity and high-temperature environment, and then the exhaust fan 49 (see FIG. 1) is driven to circulate the air.

The sheet conveyed on the conveyance surface 61*a* to the downstream side is conveyed to the cooling part 29. And, after cooled by the cooling part 29, the sheet is conveyed to the post-processing apparatus 9 (see FIG. 1) through the discharge port 33.

As described above, according to the drying apparatus 7 of the present disclosure, when the amount of moisture contained in the sheet is larger than the predetermined amount of moisture, the turn-on period of the heater 51 is set to be longer than the reference period. Thereby, energy applied to the image (the ink) is increased so that the image containing a large amount of moisture can be dried adequately, and the yellowing and the curling are prevented.

Further, the controller 95 turns on and off the adjacent heaters 51 alternately, so that a temperature gradient on the conveyance surface 61*a* is made to be smaller, and it becomes possible to heat the sheet conveyed on the conveyance surface 61*a* uniformly.

Next, modified examples of the above embodiment will be described. As shown in FIG. 3B, the heaters 51 may be disposed in a lattice shape along the conveyance direction X and the width direction Y. When the estimated amount of moisture is larger than the predetermined amount of moisture, the controller 95 alternately turns on and off the heaters 51A and 51B adjacent to in the conveyance direction X and the width direction Y, and makes the turn-on period longer than the reference turn-on period.

In this modified example as well, when the amount of moisture contained in the sheet is larger than the predetermined amount of moisture, the turn-on period of the heater 51 is set longer than the reference turn-on period, so that an image having a large amount of moisture can be appropriately dried. Further, the heaters 51 adjacent to the conveyance direction X and the width direction Y are alternately turned on and off, so that the temperature gradient on the conveyance surface 61*a* can be made to be smaller, and the sheet conveyed on the conveyance surface 61*a* can be heated more uniformly.

Next, another embodiment will be described.

In another embodiment, if the estimated amount of moisture is larger than the predetermined amount of moisture, the controller 95 may control a wavelength of the infrared light irradiated from the heater 51 to be shorter. In this case, for example, a filter (not shown) for passing a predetermined wavelength is supported by the heating part 23 in a movable manner between a radiation position below each heater 51 and a retreat position separate from the heaters 51. If the estimated amount of moisture is larger than the predetermined amount of moisture, the controller 95 moves the filter from the retreat position to the radiation position. Thus, the wavelength of infrared light irradiated from the heater 51 can be shifted to a short range.

Also in this case, when the amount of moisture contained in the sheet is larger than the predetermined amount of moisture, the energy of the irradiated infrared light is increased. Therefore, an image having a large amount of moisture can be appropriately dried.

In still another embodiment, if the estimated amount of moisture is larger than the predetermined amount of moisture, the controller 95 may control the conveyance motor 69 such that the conveyance speed of the sheet is set to be lower than the reference conveyance speed. In this case, since the period during which the sheet passes on the conveyance surface 61*a*, that is, the period during which the infrared light is irradiated on the sheet is longer than in the case of the reference conveyance speed, the amount of energy received by the sheet is increased. Therefore, an image having a large amount of moisture can be appropriately dried.

In still another embodiment, if the estimated amount of moisture is larger than the predetermined amount of moisture, the controller 95 may control the lift motor 73 such that the conveyance surface 61*a* of the conveyance belt 61 is close to the heating part 23. In this case, the distance between the heating part 23 and the sheet conveyed on the conveyance surface 61*a* becomes shorter than the reference distance, and the intensity of the infrared light irradiated on the sheet becomes strong, so that an image having a large amount of moisture can be appropriately dried.

In the above embodiment, when the ambient humidity is higher than the reference humidity (the first estimation method), when the thickness of the sheet is thicker than the reference thickness (the second estimation method), or when the amount of ink is larger than the reference amount (the third estimation method), the controller 95 estimates that the amount of moisture contained in the sheet is large. However, since the amount of moisture contained in the sheet is most affected by the ambient humidity, it may be estimated that the amount of moisture contained in the sheet is large at least when the ambient humidity is higher than the reference humidity (the first estimation method). Alternatively, the second estimation method or the third estimation method may be combined with the first estimation method.

When the amount of moisture contained in the sheet is estimated to be larger than the predetermined amount of moisture, the controller 95 may control both the heating part 23 and the conveyance part 25 so as to increase the amount of energy received by the image. For example, the turn-on period of the heater 51 of the heating part 23 may be set to be longer than the reference period, and the conveyance speed of the conveyance belt 61 may be set to be slower than the reference speed.

In the above embodiment, the ambient humidity, the thickness of the sheet, and the amount of ink are compared with the reference values to estimate the amount of moisture contained in the sheet, and when the estimated amount of moisture is larger than the predetermined amount of moisture, the amount of energy received by the image is increased. However, the reference values to be compared may be set to two or more levels to increase the amount of energy received by the image to two or more levels. Furthermore, the amount of energy received by the ink may be adjusted based on the absolute values of the ambient humidity, the thickness of the sheet, and the amount of ink.

Although the present disclosure has been described with respect to specific embodiments, the present disclosure is not limited to the embodiments described above. Those skilled in the art will be able to modify the above embodiments without departing from the scope and spirit of the present disclosure.

The invention claimed is:

1. A drying apparatus which dries a medium on which an image is formed with ink while conveying the medium, the drying apparatus comprising:

a conveyance part which conveys the medium in a predetermined conveyance direction;

a heating part which supplies energy to the image on the sheet conveyed in the conveyance part and dries the image;

a measurement part which measures a value accompanied with moisture contained in the medium; and a controller which estimates an amount of moisture contained in the medium based on the value measured by the measurement part, and controls at least one of the conveyance part and the heating part so as to change an amount of the energy supplied to the image based on the estimated amount of moisture.

2. The drying apparatus according to claim 1, wherein the controller compares the estimated amount of moisture with a reference amount of moisture, and when the estimated amount of moisture is larger than the reference amount of moisture, the controller controls at least one of the conveyance part and the heating part so as to increase the amount of the energy supplied to the image.

3. The drying apparatus according to claim 2, wherein the heating part includes a plurality of heaters which can be turned on and off individually at a predetermined frequency, and when the estimated amount of moisture is larger than the reference amount of moisture, the controller controls the heaters such that a turn-on period of the heaters is set to be longer than a reference turn-on period.

4. The drying apparatus according to claim 3, wherein the heaters are disposed side by side in the conveyance direction, and the controller controls the heaters such that the adjacent heaters are turned on and off alternately.

5. The drying apparatus according to claim 3, wherein the heaters are disposed in a lattice shape in the conveyance direction and a width direction perpendicular to the conveyance direction, the controller controls the heaters such that the adjacent heaters in the conveyance direction and in the width direction are turned on and off alternately.

6. The drying apparatus according to claim 2, wherein the heating part includes a heater irradiating light, when the estimated amount of moisture contained in the sheet is larger than the reference amount of moisture, the controller controls the heating part such that a wavelength of the light is shifted to be shorter than a reference wavelength.

7. The drying apparatus according to claim 2, wherein when the estimated amount of moisture contained in the sheet is larger than the reference amount of moisture, the controller controls the conveyance part such that a conveyance speed of the medium is slower than a reference conveyance speed.

8. The drying apparatus according to claim 2, wherein the conveyance part or the heating part is configured to be movable to change a distance between the conveyance part and the heating part, and when the estimated amount of moisture contained in the sheet is larger than the reference amount of moisture, the controller moves the conveyance part or the heating part such that the distance between the conveyance part and the heating part is shorter than a reference distance.

9. The drying apparatus according to claim 1, wherein the measurement part is a humidity sensor which detects an ambient humidity, and when the ambient humidity detected by the humidity sensor is higher than a reference humidity, the controller estimates that the amount of moisture contained in the medium is larger than the predetermined amount of moisture.

10. The drying apparatus according to claim 9, wherein the measurement part is a sensor which detects a thickness of the medium, when the thickness of the medium detected by the sensor is larger than a reference thickness, the controller estimates that the amount of moisture contained in the medium is larger than the predetermined amount of moisture.

11. The drying apparatus according to claim 10, wherein the measurement part is an ultrasonic sensor having a transmission part which transmits ultrasonic wave toward the medium and a reception part which receives the ultrasonic wave passed through the medium, the controller compares an intensity of the ultrasonic wave received by the reception part with an intensity of a reference ultrasonic wave, and when the intensity of the ultrasonic wave received by the reception part is larger than the intensity of the reference ultrasonic wave, the controller estimates that the amount of moisture contained in the medium is larger than the predetermined amount of moisture.

12. The drying apparatus according to claim 9, wherein the measurement part is a count unit which calculates an amount of the ink, when the amount of the ink calculated by the count unit is larger than a reference amount, the controller estimates that the amount of moisture contained in the medium is larger than the predetermined amount of moisture.

13. An image forming system comprising:

an image forming apparatus which forms an image on a sheet; and the drying apparatus according to claim 1, the drying apparatus drying the medium on which the image is formed by the image forming apparatus, while conveying the medium.

* * * * *